United States Patent [19]

Vollan et al.

[11] 3,968,858

[45] July 13, 1976

[54] CLIMBING DEVICE

[76] Inventors: Douglas D. Vollan, 115 Ardmore Road, Berkeley, Calif. 94707; George W. Walsh, 330 Civic Drive, Walnut Creek, Calif. 94596

[22] Filed: May 14, 1975

[21] Appl. No.: 577,399

[52] U.S. Cl. ..... 182/135; 182/136

[51] Int. Cl.[2] ..... A63B 27/02

[58] Field of Search ..... 182/135, 134, 133, 9, 182/187, 188, 3, 5; 188/65.1

[56] References Cited

UNITED STATES PATENTS

| | | | |
|---|---|---|---|
| 1,168,321 | 1/1916 | Maley | 182/135 |
| 1,412,179 | 4/1922 | Hoen | 182/134 |
| 1,927,469 | 9/1933 | Plumpton | 182/8 |
| 2,330,288 | 9/1943 | Hurley | 182/134 |
| 3,348,632 | 10/1967 | Swager | 182/8 |
| 3,410,364 | 11/1968 | Fountain | 182/9 |
| 3,523,591 | 8/1970 | Fountain | 182/8 |
| 3,860,089 | 1/1975 | Huggett | 182/4 |

*Primary Examiner*—Reinaldo P. Machado
*Attorney, Agent, or Firm*—C. Michael Zimmerman

[57] ABSTRACT

Apparatus is described for climbing a sailboat mast or other vertical structure. The apparatus includes a track which extends upward along the mast and a pair of climbing devices which are usable by an operator to raise himself up along the track. Each of the climbing devices includes a carriage which is mounted on the track for sliding movement therealong and a lever bar pivotally mounted to the carriage for locking the device at any selected location along the track. The locking action is obtained by the application of downward force on the locking lever causing an end of the same to frictionally engage the track. One of the locking levers is adapted to receive the feet of an operator, whereas the other is adapted for hand grasping. The apparatus is used by the operator engaging his feet and hands with the foot and hand devices respectively and then climbing the mast by alternately sliding the foot and hand devices upward along the track.

7 Claims, 6 Drawing Figures

CLIMBING DEVICE

BACKGROUND OF THE INVENTION

This invention relates to apparatus which is responsive to a load tending to move in a direction along a path by blocking such movement and, more particularly, to a simple and yet effective climbing device enabling a vertical structure, such as a pole or a sailboat mast, to be easily climbed.

There are many instances in which it is desired to adjustably prevent a load from moving. For example, it is often desired to be able to climb a vertical structure and have appartus of one sort or another which will support the weight of the climber both during the climb and at an elevated destination. That is, the weight of the climber is a load which must be prevented from being moved downward by gravity not only during the climb but also at the height which is to be achieved.

Sailboat owners often wish to repair or make adjustments near the top of the mast of their sailboat. However, there has not been available a simple way in which an owner or other personnel can safely climb the mast to make such repairs or adjustments. In this connection, while climbing devices have been designed in the past for mounting a pole or the like, they have, in general, been too complicated or untrustworthy for adoption.

SUMMARY OF THE INVENTION

The present invention provides quite simple and yet effective apparatus for responding to a load tending to move in a direction along a path by blocking such movement. The principles of the apparatus are especially suited to the apparatus taking the form of a climbing device, i.e., a device for scaling a generally vertical structure. With such a device, the load is the weight of a human operator or the like normally being urged downward by the force of gravity. Broadly, the apparatus includes a track which extends along the path the load tends to move, e.g., vertically when the apparatus is being used to climb a vertical structure. The apparatus further includes a carriage mounted on the track for slidable movement therealong, and cooperable interengaging structures on the track and carriage which essentially prevent transverse movement of the carriage away from the track.

As a particularly salient feature of the apparatus, it includes a blocking lever bar which is pivotally mounted on the carriage at a location and in such an orientation that the load will apply pivotal pressure to a first side of its pivotal mounting upon the load tending to move in the direction which it is desired be blocked. The location and orientation of the bar pivotal mounting is such that when a load applies such a pivotal pressure on a first side of it, the end of the bar on the opposite side of the pivotal mounting will frictionally engage the track to provide resistance to movement of the blocking lever bar and, hence, the carriage and the load.

Desirably, the length of the lever bar on its aforementioned opposite side of the pivotal mounting is greater than the distance maintained by the cooperable interengaging structures between such pivotal mounting and the track. The result is that generally sufficient frictional force will be generated to completely prevent movement of the blocking lever bar and load assuming, of course, that the structural integrity of the parts are capable of withstanding the generated amount of force. Also, it is preferred that the distance from the pivotal mounting of the location at which the load applies pressure to the bar be significantly greater than the distance between such pivotal mounting and the end of the bar which frictionally engages the track. The bar will then act as a lever which generates a force at the point of frictional engagement which is greater than the load force. The above two dimension relationships will therefore assure that the apparatus will not only resist movement of the load, but actually prevent such movement.

As another desirable feature, the blocking lever bar is pivotally mounted both for movement in a direction which will block the load and for movement in the opposite direction. Such movement in the opposite direction will release the frictional engagement of the lever bar's end with the track in order to permit the carriage to freely slide along the track. This feature is particularly significant when the apparatus is a climbing device since it enables an operator to alternately slide the device upward (or downward when descending) along the track and then lock it in position, i.e., "step" upward or downward as the case may be.

The invention includes other features and advantages which will be described or will become apparent from the following more detailed description of a preferred embodiment.

BRIEF DESCRIPTION OF THE DRAWINGS

With reference to the accompanying two sheets of drawing.

DETAILED DESCRIPTION OF THE PREFERRED EMBODIMENT

Figure 1:
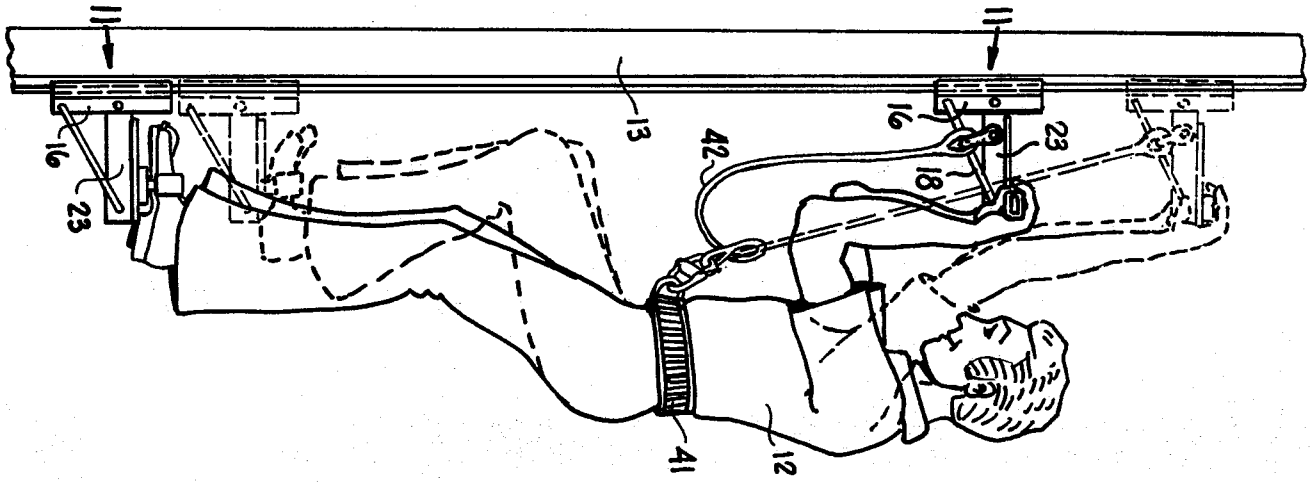
FIG. 1 is an elevation view of preferred embodiments of the apparatus of the invention being used by an operator to ascend a mast or the like, the phantom showing illustrating the operator's climbing motion.
Figure 2:
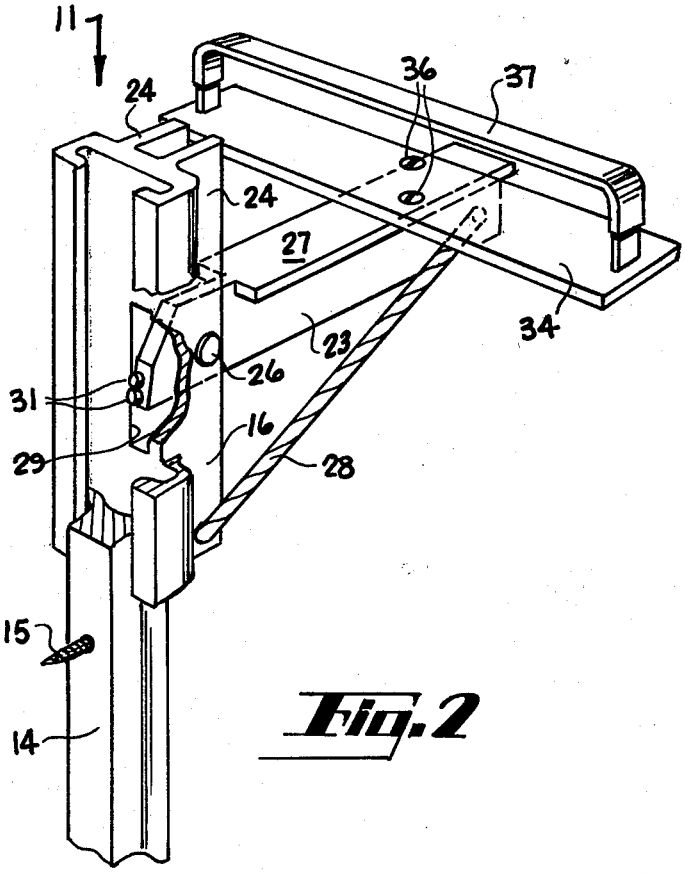
FIG. 2 is an enlarged, broken-away isometric view of a preferred embodiment of the invention adapted to support the feet of an operator.

FIG. 1 illustrates the use of a pair of climbing devices 11 incorporating the invention, by an operator 12 ascending a sailboat mast 13 or other similar vertical structure. As best illustrated in FIG. 2, the apparatus includes a track 14 which is secured via screws 15, for example, to the mast and extends vertically upward therealong.

Figure 5:
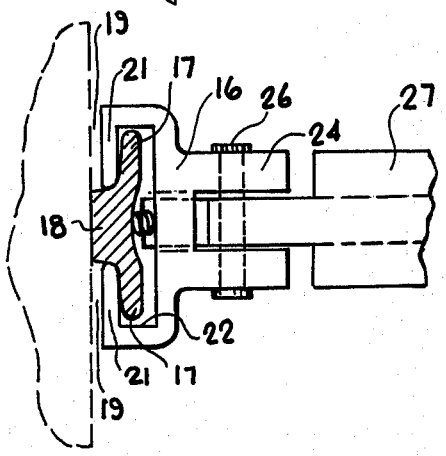
FIG. 5 is a partial sectional view taken along a plane indicated by the lines 5—5 in FIG. 4.

Each of the climbing devices includes a carriage 16 which is slidably received on the track. In this connection, as best shown in FIG. 5, the track 13 includes a pair of flanges 17 which respectively extend transversely outward from opposite sides of a base portion 18 of the track. The flanges 17 thus cooperate with the structure to which the track is secured to define a pair of opposed, outwardly opening slots 19 which extend lengthwise of the track, i.e., along the path to be travelled by the climbing devices. The structure of the carriage includes a pair of inwardly extending lips 21 which extend into the slots 19. Thus, a pair of opposed channels 22 are provided on the base carriage having their openings facing one another and receiving the flanges 17.

In view of the above structure, the carriage is mounted on the track for slidable movement therealong. As a particularly important point, though, the cooperable interengaging structures defined by the track flanges and base channels essentially prevent outward transverse movement of the carriage away from the track beyond a set distance. This is an important aspect of the structure insofar as its principle of operation is concerned as will become apparent during its description later herein.

The climbing device also includes a blocking lever bar 23 which is pivotally mounted to the carriage 16. To this end, the carriage 16 has a pair of spaced apart, parallel plates 24 which extend lengthwise along the base of the carriage and define therewith a U-shaped yoke within which the lever bar 23 is pivotally mounted by a pin 26. As illustrated, the lever bar 23 extends outwardly from between the plates 24 and, once clear of the carriage, is T-shaped in cross-section with the bar of the T being formed by a generally horizontal support plate 27. An elastic band 28 is secured in slight tension between the outward, free end of the bar 23 and the lower end of the carriage.

Figure 4:
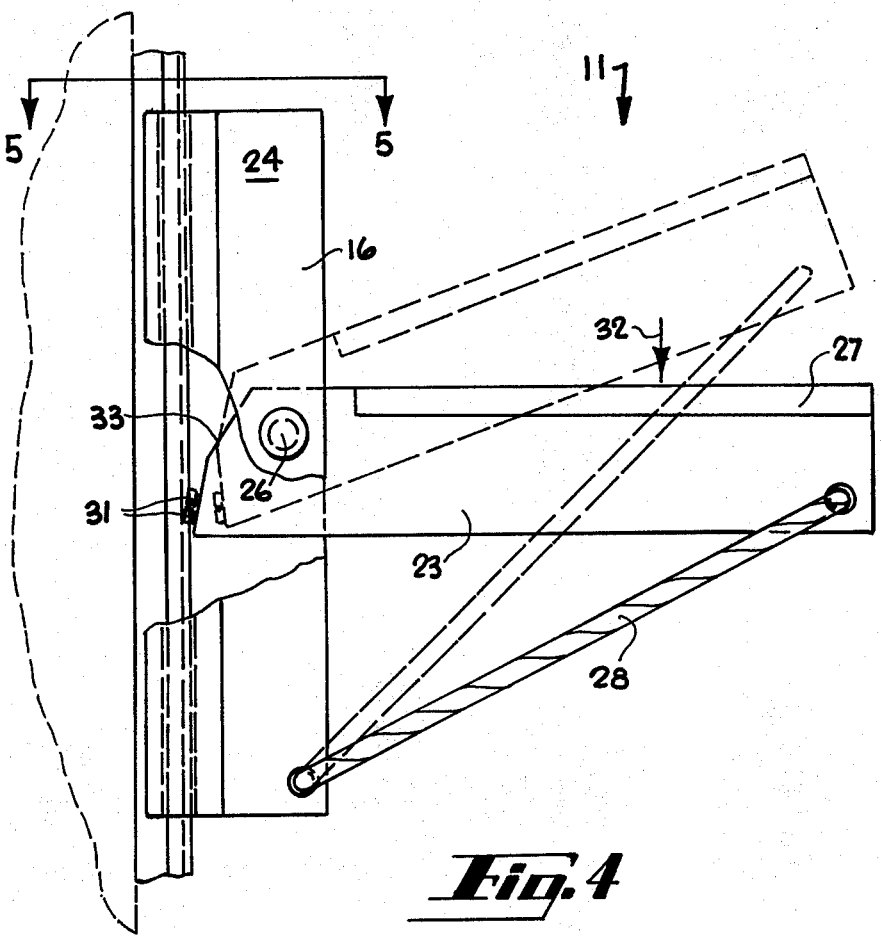
FIG. 4 is an enlarged elevation view of a preferred embodiment with parts broken away and omitted to facilitate a showing of the operation of the invention.

As best illustrated in FIG. 2, the end of the lever bar 23 on the opposite side of the pin 26, i.e., the inner end, extends through a slot 29 in the base of the carriage to a location at which it can frictionally engage the track 13. In this connection, a pair of pins 31 of a hard material, such as steel, are embedded within the lower portion of such end of the bar to provide the actual frictional contact with the track. The lever bar has a length dimension inwardly of the pin 26 which is greater than the distance between such pin and the track. More particularly, as best shown in FIG. 4, the distance between the pin 26 and the outer ends of the pins 31 is greater than the shortest distance between the pin and such track. The result is that the bar end will engage the track as illustrated, rather than be allowed to pivot freely by such track. In this connection, the cooperable interengaging structures on the track and carriage will prevent the carriage from moving outward away from the track sufficiently far to escape the frictional engagement. That is, the rear surface of each of the flanges 17 will be engaged by an opposed, interior surface of the corresponding channel 22. Such engagement not only will prevent the carriage from moving outward away from the track, but it will also provide an additional frictional engagement which will resist movement of the carriage lengthwise along the track whenever the lever bar engages such track and urges the carriage outwardly away from it.

Most desirably, the distance between the pivot pin 26 and the free ends of the engagement pins 31 is such that engagement will occur when the upper surface of the lever bar 23 is in a generally horizontal plane (generally normal to the track) as shown in FIG. 4. This engagement of the end of the lever bar with the track will prevent further pivotal motion of the lever bar in a downward direction. However, any increase in load tending to cause such pivotal movement will apply pressure to the bar causing a correspondingly greater frictional engagement between the pins and the track. This proportional relationship between the frictional engagement and the load force will assure that the climbing device automatically compensates for load differences which are applied thereagainst.

The distance from the pivotal mounting of the bar to the location at which the load is typically centered along the bar (as, for example, at the location indicated in FIG. 4 by the arrow 32) is significantly greater than the distance between such pivotal mounting and the point at which the bar frictionally engages the track. The result will be that the frictional force opposing downward movement of the climbing device, and hence any load being supported thereby, will be multiplied due to leverage. For example, in one working model in which the device is constructed to support a load at approximately three inches from the axis of pin 26, the distance from the axis of pin 26 to the point of contact of the pins 31 with the track is approximately ⅞ inch, and a straight line drawn between the pins 31 and the pivot pin axis is at an angle of about 45° to the horizontal; the weight of a two hundred pound man on the device will generate approximately a 412 pound force at the engagement of the pins with the track directly opposing the force of gravity acting on the operator. Of course, as the weight (or load force) supported by the lever bar increases or decreases, the supporting force at the point of contact of the pins with the track will correspondingly increase or decrease. In this connection, it should be noted that the tension provided by the elastic band 28 is chosen to provide a pivotal pressure on the bar sufficient to generate a locking force which will overcome the force of gravity on the climbing device. The band 28 therefore acts as a brake which assures that the climbing device will automatically stay at any location along a vertical track at which it is positioned.

The lever bar preferably not only responds to pivotal pressure tending to cause the pins 31 to engage the track, but also is mounted for movement to a position such as that shown in phantom in FIG. 4. That is, the bar is pivotally mounted for movement in the direction opposite that at which the load will apply pressure, in order to release its frictional engagement with the track. The result is that merely by pivoting the bar upward as shown, the carriage is free for slidable movement along the track. In this connection, the upper corner of the inner end of the bar is beveled to form a chamfer 33 for increased clearance between the bar and the track when the bar is pivoted upward in order to provide adequate clearance between the bar and protruberances from the track, such as the heads of screws 15 securing the track to the mast.

The climbing device of the invention also desirably includes additional structure facilitating its manipulation by an operator. In this connection, the climbing device of FIG. 2 is adapted for an operator's feet. That is, a foot platform in the form of a crossbar 34 is suitably secured to the plate 27 of the locking bar adjacent its outer end by bolts 36 or the like. As illustrated, the crossbar has a length transverse of the locking lever sufficient to accommodate both feet of an operator thereon. Moreover, a retaining strap 37 is provided to extend across the top of an operator's feet and maintain the foot in engagement with the platform so that such feet can be used not only to transmit the weight of the operator to the locking lever, but also to pivot such bar upward to release the frictional engagement of the end of the lever bar with the track.

Figure 3:
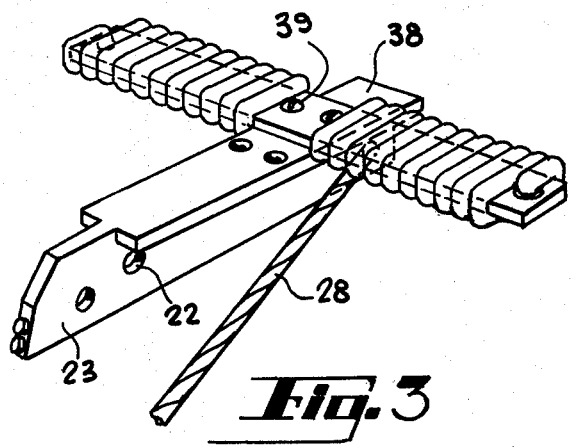
FIG. 3 is a partial isometric view of those aspects of another preferred embodiment which differ from the showing in FIG. 2 in order to adapt the device for hand gripping.

FIG. 3 illustrates the locking lever bar of a climbing device with means facilitating its manual gripping by an operator. That is, a crossbar 38 similar to the crossbar 34 in FIG. 2 is secured to the flange 27 by bolt-nut combinations 39. As illustrated, such crossbar extends outwardly beyond each side of the flange 27 and is wrapped or otherwise suitably padded to facilitate a comfortable grip by the operator's hands on opposite sides of the lever bar.

The climbing device of the invention is simply used. That is, a pair of devices, one adapted for hand gripping and the other adapted for the feet of the operator are first mounted on the track of a mast or the like. In this connection, the device is especially adapted for use with the sail track conventionally included on a mast and such devices can be slid upward into position from the bottom of such track, the hand device being the higher of the two devices. Because of the tension brake on each of the devices, they will remain at the location on the track at which they are positioned without having to be held in place. After the devices are mounted on the lower portion of the track, the operator can insert his feet between the platform 34 and the strap 37 of the foot device, and grasp the hand grip on the upper climbing device. The operator is then ready to ascend the mast by first pulling himself a short distance upward with his hands, and thereafter flexing his knees to raise his feet and the lower climbing device. He can then support himself at the raised location of his feet merely by again transfering his weight to his feet. These steps are repeated until the desired height is reached. To descend, the operator reverses the procedure. For added security, a safety belt 41 is positioned around the midriff of the operator and secured with a suitable line 42 to the lever bar 23 of the upper climbing device as shown. It should be noted that whenever the operator's weight is applied downward on the line 42 and, hence, to the blocking lever of the upper climbing device, the climbing device will be locked into position to support such weight. Although a safety belt 41 is illustrated, it will be recognized that a suitable upper and lower harness could be substituted for the same purpose. Securance by the line 42 is not only a safety feature, but enables the operator, once he has reached a desired height, to free his hands for carrying on the function for which the operator climbed the mast.

Figure 6:
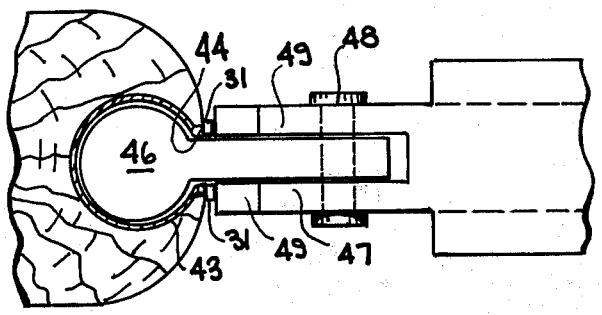
FIG. 6 is a sectional view similar to that of FIG. 5 of another preferred embodiment of the invention.

Although the invention has been described in connection with a preferred embodiment thereof, it will be appreciated by those skilled in the art that many changes and modifications can be made without departing from its spirit. In this connection, FIG. 6 illustrates in section a modification of the climbing device for so-called "interior" sail tracks on masts. That is, the track comprises a tube 43 which defines a channel extending lengthwise of the mast. The channel communicates with the exterior via a slot 44 which also extends lengthwise of the mast, i.e., along the path of the track. As illustrated, the channel has a greater transverse dimension than the slot, and the carriage is mounted on the track by including a cylindrical end projection 46 which rides within the channel and has a flange 47 extending outward through the slot for sliding movement therealong. Cylindrical end projection 46 has a much greater transverse dimension than the slot through which the flange 47 extends. The result is that this interengaging structure between the track and the carriage will prevent outward transverse movement of the carriage away from the track. Thus, these cooperable interengaging structures meet the criteria necessary to enable frictional engagement between the blocking lever bar and the track. Moreover, it is the interior surface of the channel defined by tube 43 which is engaged by the cylindrical end projection 46 to provide opposed surfaces which frictionally engage one another to cooperate with the blocking lever in resisting movement of the carriage.

The embodiment of FIG. 6 also differs from the earlier described embodiment in the manner in which the blocking lever is secured to the carriage. That is, rather than the blocking lever being pivotally secured between a pair of flanges extending outward from the carriage, the blocking lever itself is bifurcated to receive the flange 47. A pin 48 pivotally mounts the lever bar to the carriage at the appropriate location and orientation described with respect to the earlier embodiment to provide the desired frictional engagement between the lever bar and track. In this connection, engagement pins 31 are provided at the end of both of the forks 49 making up the pivotally secured end of the blocking lever bar for frictional engagement of the mast on opposite sides of the slot 44.

Other modifications and changes can be made to the invention without departing from its spirit. For example, a climbing device can be provided for each foot of the operator and/or each hand of the operator, rather than only one for the hands and one for both the feet as described. Also, a pair of tracks could be provided on opposite sides of the mast so that climbing devices adapted for single foot securance can be used on such opposite sides for the operator to literally "walk" up the mast by alternate vertical steps. Because of these and other changes, it is intended that the coverage afforded applicants be limited only by the claims and their equivalent language.

We claim:

1. Apparatus responsive to the weight of a human operator tending to move in a downward direction along a generally vertical path by blocking said movement comprising:

A. a track extending generally rigidly along said path;

B. a carriage mounted on said track for slidable movement therealong;

C. cooperable interengaging structures on said track and said carriage essentially preventing outward transverse movement of said carriage away from said track and circumferential movement of said carriage around said track;

D. a blocking lever bar pivotally mounted on said carriage at a location and in an orientation at which upon tending to move in said downward direction said weight of said human operator will apply pivotal pressure to said bar on a first side of its pivotal mounting to said carriage causing frictional engagement with said track of its end on the opposite side of said pivotal mounting, whereby movement of said human operator downward is resisted by said blocking lever bar;

1. said lever bar having a length on the opposite side of said pivotal mounting which is greater than the distance between said pivotal mounting and said track, the distance from said pivotal mounting on the location at which the weight of said human operator applies pressure to said bar on said first side being greater than the distance between said pivotal mounting and said end of said bar on said opposite side, whereby said frictional engagement in response to said application of the weight of a human operator will be provided with leverage pressure; and 2. said blocking lever bar being pivotally mounted for movement in the direction opposite to that at which said weight of said human operator will apply pressure thereagainst in order to release said frictional engagement with said track of the end of said bar on the opposite side of said pivotal mounting, whereby said carriage is free for slidable movement along said track; and E. means adapting said lever bar for supporting the weight of a human operator, said means including a foot platform secured to said bar on said first side of its pivotal mounting and a retaining member for maintaining said platform in engagement with any foot thereon upon said foot moving in said opposite direction to release said frictional engagement of said end of said lever bar with said track, said foot platform and retaining member being sized to accommodate both feet of an operator.

2. The apparatus of claim 1 further including tension brake means extending between said first side of said blocking lever bar and said carriage applying limited pivotal pressure on said lever bar causing initial frictional engagement of said end with said track to resist downward movement of said carriage on said track whenever a load is not being supported thereby.

3. The apparatus of claim 1 wherein said cooperable interengaging structures includes a pair of opposed surfaces respectively on said track and said carriage which frictionally engage one another upon said lever bar frictionally engaging said track and urging said carriage toward outward transverse movement away from said track.

4. The apparatus of claim 3 wherein said cooperable engaging structures includes a pair of flanges extending outward respectively on opposite sides of said track and a corresponding pair of opposed channels having their openings facing one another on said carriage and receiving said flanges, the rear surface of each of said flanges and the interior surface of its corresponding channel providing said opposed surfaces which frictionally engage one another upon said lever bar frictionally engaging said track and urging said carriage toward outward transverse movement away from said track.

5. The apparatus of claim 3 wherein said cooperable engaging structures on said track and said carriage include a channel extending along said track with a slot communicating therewith parallel to said path, said channel having a greater transverse dimension than said slot; and a projection on said carriage extending through said slot and riding within said channel, the portion of said projection inside said channel having a greater transverse dimension than said slot and the interior surface of said channel and the exterior surface of said portion of said projection providing said opposed surfaces which frictionally engage one another upon said lever bar frictionally engaging said track and urging said carriage toward outward transverse movement away from said track.

6. The apparatus of claim 5 wherein said end of said blocking lever bar on the opposite side of said pivotal mounting is bifurcated and engages said track on the opposite sides of said slot upon being caused by pivotal pressure on said lever to frictionally engage said track.

7. The apparatus of claim 1 further including:

A. a second carriage mounted on said track for slidable movement therealong;

B. cooperable interengaging structures on said track and said second carriage essentially preventing outward transverse movement of said second carriage away from said track and circumferential movement of said carriage around said track;

C. a second blocking lever pivotally mounted on said second carriage at a location and in an orientation at which upon tending to move in said downward direction said weight of said human operator will apply pivotal pressure to said second bar on a first side of its pivotal mounting to said second carriage causing frictional engagement with said track of its end on the opposite side of said pivotal mounting, whereby movement of said human operator downward is resisted by said second blocking lever bar;

1. said second lever bar having a length on the opposite side of said pivotal mounting which is greater than the distance between its pivotal mounting and said track, and the distance from said pivotal mounting of the location at which said weight of said human operator applies pressure to said second bar on said first side being greater than the distance between said pivotal mounting and said end of said second bar on said opposite side, whereby said frictional engagement in response to said application of the weight of a human operator will be provided with leverage pressure; and 2. said second lever bar being pivotally mounted for movement in the direction opposite to that in which said weight of said human operator will apply pressure thereagainst in order to release said frictional engagement with said track of the end of said second bar on the opposite side of said pivotal mounting, whereby said second carriage is free for slidable movement along said track; and D. means adapting said lever bar for supporting the weight of a human operator including a cross bar secured to said second lever bar providing a grip for both hands of said operator.

* * * * *